US006318499B1

(12) United States Patent
Honein et al.

(10) Patent No.: US 6,318,499 B1
(45) Date of Patent: Nov. 20, 2001

(54) COMPOSITE SCAFFOLDING PLANK INCLUDING NATURAL WOODEN AND LAMINATED WOODEN BOARDS AND METHODS OF FORMING SAME

(76) Inventors: Joseph Honein, 11040 Jones Rd. West, Houston, TX (US) 77065; Carl R. Cook, 13918 E. Cypress Forest, Houston, TX (US) 77070

( * ) Notice: Subject to any disclaimer, the term of this patent is extended or adjusted under 35 U.S.C. 154(b) by 0 days.

(21) Appl. No.: 09/320,228

(22) Filed: May 26, 1999

Related U.S. Application Data

(63) Continuation-in-part of application No. 08/739,799, filed on Oct. 30, 1996, now abandoned

(60) Provisional application No. 60/005,774, filed on Oct. 31, 1995.

(51) Int. Cl.[7] ..... E04G 1/16

(52) U.S. Cl. ..... 182/222; 182/119

(58) Field of Search ..... 182/222, 119; 428/114, 218, 217, 212; 52/720, 782.1, 729.4, 730.7

(56) References Cited

U.S. PATENT DOCUMENTS

| | | | |
|---|---|---|---|
| 1,167,988 | | 1/1916 | Faulkner . |
| 2,087,958 | | 7/1937 | Allen . |
| 2,118,048 | * | 5/1938 | Landsem . |
| 2,230,628 | * | 2/1941 | Sahlberg . |
| 2,569,450 | | 10/1951 | Bouton . |
| 2,650,395 | | 9/1953 | De Anguera . |
| 3,099,301 | | 7/1963 | Bennett . |
| 3,144,892 | | 8/1964 | Webster . |
| 4,534,448 | | 8/1985 | Trainer . |
| 5,120,378 | | 6/1992 | Porter et al. . |

FOREIGN PATENT DOCUMENTS

| | | | | |
|---|---|---|---|---|
| 84807 | | 5/1958 | (DK) . | |
| 285787 | | 10/1998 | (EP) . | |
| 720603 | * | 12/1954 | (GB) | 182/222 |
| 446606 | | 4/1975 | (RU) . | |

* cited by examiner

*Primary Examiner*—Alvin Chin-Shue
(74) *Attorney, Agent, or Firm*—Kenneth H. Johnson

(57) ABSTRACT

A composite scaffolding plank made from a plurality of wooden boards positioned in side to side parallel abutment. At least one of such boards is a whole natural wooden board, and at least one of such boards is a laminated wooden board. A plurality of spaced pins extend transversely through the wooden boards. A cam means on the pins pulls and holds the boards together. In addition, my invention is a method of forming wide wooden planks from two or more narrow wooden boards (as described) by positioning the boards in side to side parallel abutment and embedding a plurality of spaced pins transversely through the boards. Further, a method of increasing the strength of a wooden plank is to cut the plank longitudinally into sections, add at least one laminated wooden board, position the sections in side to side parallel abutment, and subsequently embed a plurality of spaced pins in the sections.

17 Claims, 8 Drawing Sheets

FIG. 7

| Comparison Results | | | | |
|---|---|---|---|---|
| | Pinned (natural + laminated) | Pinned (all natural) | solid | Laminated |
| Modulus of Elasticity | $2.18 \times 10^6$ | $2.0 \times 10^6$ | $1.8 \times 10^6$ | $1.8 \times 10^6$ |
| Flexural Stress | 2950 psi | 2,600 psi | 2,200 psi | 2,900 psi |
| Horizontal Sheer Stress | 145 psi | 120 psi | 90 psi | 145 psi |

FIG. 8

| Failure Results | | |
|---|---|---|
| Type of board | Average Failure Load (lbs) | Comments |
| Pinned (natural + laminated) | 2850 psi | One member out of three fails first |
| Pinned (all natural) | 2700 psi | One member out of three fails first |
| Solid | 2200 psi | Whole Unit Fails |
| Laminated | 2400 psi | Whole Unit Fails |

FIG. 9

| Deflection Results | | |
|---|---|---|
| Type of board (7 ft span) | Deflection @ 50 psf Load (in) | OSHA Allowable Deflection (in) |
| Pinned (natural + laminated) | 0.72 | 1.4 |
| Pinned (all natural) | 0.73 | 1.4 |
| Solid | 0.81 | 1.4 |
| Laminated | 0.73 | 1.4 |

COMPOSITE SCAFFOLDING PLANK INCLUDING NATURAL WOODEN AND LAMINATED WOODEN BOARDS AND METHODS OF FORMING SAME

This application is a continuation-in-part and claims the benefit of U.S. Non-Provisional Patent Application No. 08/739,799 filed by Honein on Oct. 30, 1996, abandoned, which itself claims the benefit of U.S. Provisional Patent Application No. 60/005,774 filed by Honein on Oct. 31, 1995.

BACKGROUND OF THE INVENTION

1. Field of Invention

This invention relates to scaffolding planks. More specifically, this invention is directed to a composite scaffolding plank and a method for forming the same. The composite scaffolding plank is an improved, low cost wide scaffolding plank formed by pinning and anchoring a plurality of narrow wooden boards, at least one of which is a whole natural wooden board and at least one of which is a laminated wooden board. In addition, the strength of a wooden plank may be improved by cutting the plank longitudinally into sections, adding at least one laminated wooden board and pinning the plank sections together as described above.

2. Related Art

Prior to this invention, two types of scaffolding planks existed in the prior art: the solid single board plank and the laminated plank. The solid single board plank comprises one wide wooden board. The laminated plank is constructed from multiple layers of wooden strips glued together. Each of the two types of prior art scaffolding planks have advantages and disadvantages.

With respect to the disadvantages, due to the limited resources of old growth forests and the harvesting schemes for new growth timber, the yield of wooden boards wide enough from which to construct a solid single board plank is decreasing. Typically, only the center portion of a large tree is sufficiently broad to produce a solid single board plank. Thus, with decreasing yield, the solid single board planks are becoming more costly and difficult to make. The main disadvantage of laminated planks is that laminated planks primarily consist of glued layers of wooden strips, which glued layers of wooden strips absorb substantial amounts of moisture. After absorbing enough moisture, the wooden fibers of the laminated plank soften and the moisture hastens decay in the scaffolding board. Likewise, any time one of the veneers of the laminated plank cracks, the laminated plank looses its strength and consistency and can also no longer be used as a scaffolding.

With respect to the advantages, the solid single board planks are comparitively stronger and easier to manufacture than the laminated planks. In turn, the laminated planks, if oriented correctly, are comparitively more rigid than the solid single board planks. Moreover, laminated planks, when used in dry conditions, do not shrink as much as solid single board planks.

Applicant's co-pending application entitled Composite Scaffolding Plank and Method for Forming Same, which was filed on even date herewith, provides a safe third alternative to the solid single board plank and the laminated plank and reduces, if not eliminates, the disadvantages of the two types of prior art planks. However, the plank disclosed in Applicant's co-pending application does not benefit from the advantages inherent in the prior art solid single board plank and laminated plank.

It would be beneficial to the prior art to construct a scaffolding plank that optimizes and combines the advantages of both the single solid board plank and the laminated plank while greatly reducing, if not eliminating, their respective disadvantages.

Scaffolding planks are however strictly regulated. The Occupational Safety and Health Administration, OSHA, as well as the Southern Pine Inspection Bureau, SPIB, outline strict standards for scaffolding planks. Pursuant to such regulations, scaffolding boards must comply with certain width, breakage, and quality standards. The OSHA and SPIB standards are strict because workers entrust their lives to the scaffolding. The prior art would thus benefit from a scaffolding plank, as described above, that meets and preferably exceeds the OSHA and SPIB standards.

Because the lives of workers hinge on the integrity of scaffolding planks, any safety factors that can be added to a scaffolding plank greatly enhance the value of the scaffolding plank. It would be beneficial to the prior art to provide a scaffolding plank, as described above, that also includes an additional worker safety factor.

Moreover, so that workers do not slip while stepping on the scaffolding planks, it is important for the scaffolding planks to have a non-slippery top surface. Natural wooden boards are typically smooth, and must be manipulated to be provided with an artificial non-slippery top surface. However, such manipulation normally also weakens the board. It would thus be beneficial to the prior art to provide a scaffolding plank that includes a non-slippery top surface. It would also be beneficial to the prior art to provide such a non-slippery scaffolding plank that includes natural wooden boards which have not been weakened during any artificial surface texturing.

Manufactured wide boards for scaffolding are unknown to the prior art. Prior references, however, disclose structural wood assemblies formed from a plurality of smaller wood boards. Illustrative of such wood assemblies are U.S. Pat. No. 2,650,395 that issued to de Anguera on Sep. 1, 1953, U.S. Pat. No. 5,120,378 that issued to Porter et al. on Jun. 9, 1992, U.S. Pat. No. 4,534,448 that issued to Trainer on Aug. 13, 1985, U.S. Pat. No. 1,167,988 that issued to Faulkner on Jan. 11, 1916, U.S. Pat. No. 2,569,450 that issued to Bouton on Oct. 2, 1951.

The assembly shown in U.S. Pat. No. 2,650,395 discloses a method of forming wood flooring from relatively narrow pieces of wood having varying lengths. The pieces of wood are placed in a number of parallel rows wherein the pieces are placed end to end. A plurality of spaced thin connector keys are driven into lateral bores in the aligned pieces and hold the pieces together.

U.S. Pat. No. 5,120,378 discloses an apparatus and method for producing a prestressed wood material beam. The wood beams are held together using adhesives or mechanical fasteners such as nails or staples.

Though the above mentioned devices and assemblies may be helpful for their intended purposes, none disclose a manufactured scaffolding plank that meets OSHA and SPIB requirements and that optimizes and combines the advantages of both the single solid board plank and the laminated plank while greatly reducing, if not eliminating, their respective disadvantages.

SUMMARY OF THE INVENTION

Accordingly, the objectives of this invention are to provide, inter alia, a composite scaffolding plank and method for forming same that:

meets the OSHA and SPIB requirements;

optimizes and combines the advantages of both the single solid board plank and the laminated plank while greatly reducing, if not eliminating, their respective disadvantages;

comprises a plurality of relatively narrow boards to form a relatively wide board;

includes a tensioning device that pulls the boards together and prevents their separation;

includes an additional worker safety factor;

includes spaced connectors such that, when one of the members of the scaffold board breaks, the member and the remainder of the scaffolding board remains solid beyond the nearest connector;

includes separate parallel boards such that a break initiated by an imperfection in one of the narrow boards will not spread to the connected narrow boards;

includes a non-slippery top surface;

includes a non-slippery top surface and also includes natural wooden boards which have not been weakened during any artificial surface texturing;

affords an inexpensive source for relatively wide boards and alleviates the scarcity of wide boards; and is easily and inexpensively manufactured from readily available resources.

Other objects of the invention will become apparent from time to time throughout the specification and claims as hereinafter related.

To achieve such improvements, my invention is a composite scaffolding plank made from a plurality of wooden boards positioned in side to side parallel abutment. At least one of such boards is a whole natural wooden board, and at least one of such boards is a laminated wooden board. A plurality of spaced pins extend transversely through the wooden boards. A cam means on the pins pulls and holds the boards together. In addition, my invention is a method of forming wide wooden planks from two or more narrow wooden boards (as described) by positioning the boards in side to side parallel abutment and embedding a plurality of spaced pins transversely through the boards. Further, a method of increasing the strength of a wooden plank is to cut the plank longitudinally into sections, add at least one laminated wooden board, position the sections in side to side parallel abutment, and subsequently embed a plurality of spaced pins in the sections.

BRIEF DESCRIPTION OF THE DRAWINGS

The manner in which these objectives and other desirable characteristics can be obtained is explained in the following description and attached drawings in which:

FIG. 7 is a table showing the results of the tests performed on the composite scaffolding boards.

FIG. 8 is a table showing the results of the tests performed on the composite scaffolding boards.

FIG. 9 is a table showing the results of the tests performed on the composite scaffolding boards.

DETAILED DESCRIPTION OF THE INVENTION

Figure 1:
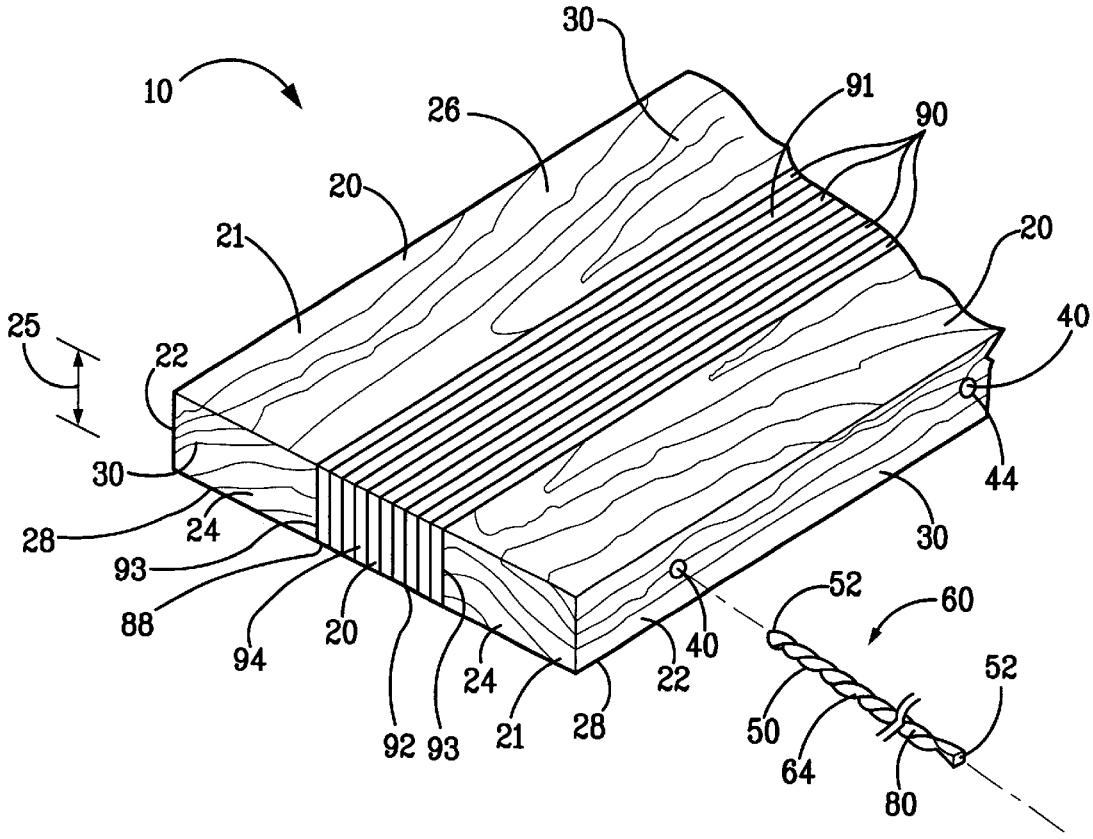
FIG. 1 is a partial isometric exploded view of the composite scaffolding plank showing the pin removed from the bore.
Figure 2:
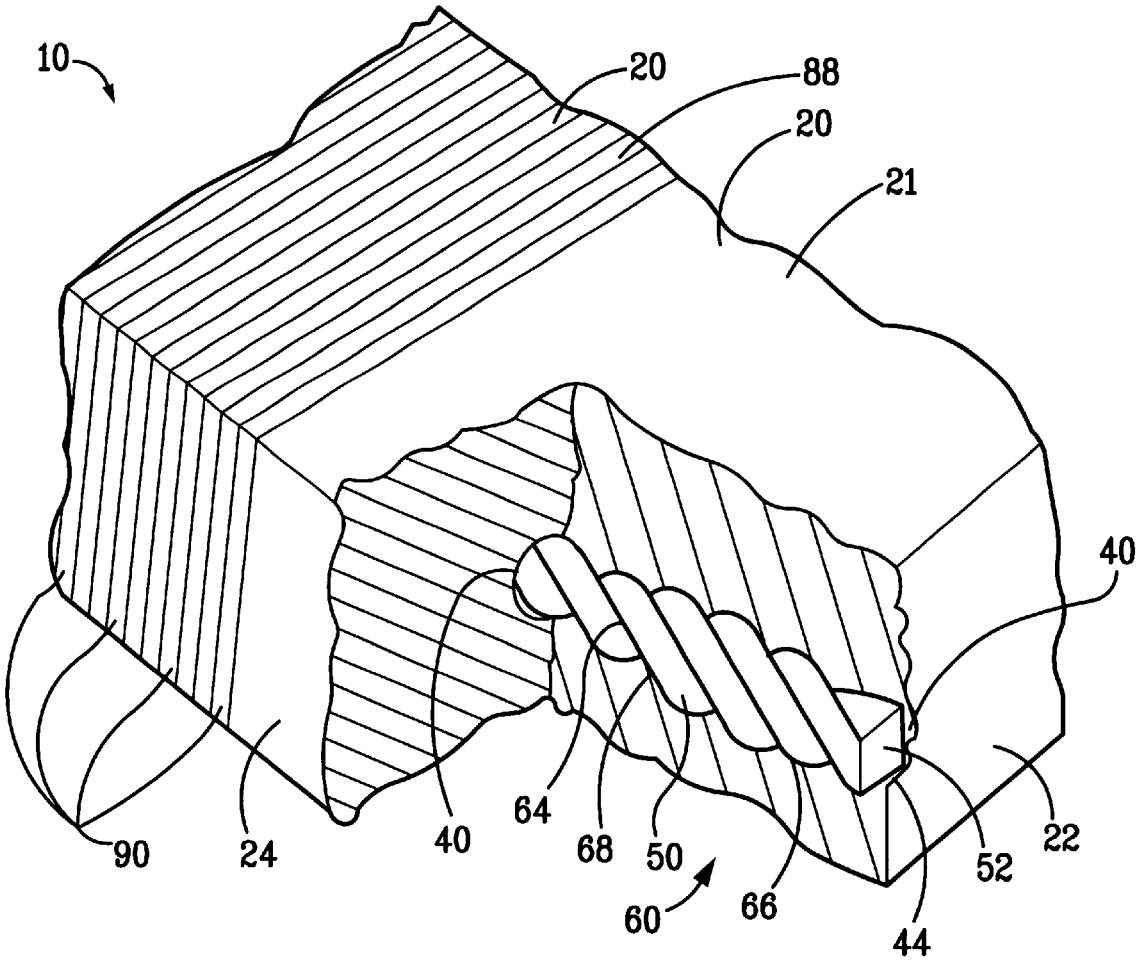
FIG. 2 is a partial cross sectional isometric view of the scaffolding plank showing the pin in the bore.

The preferred embodiment of my invention is illustrated in FIGS. 1 through 10 and the composite scaffolding plank is depicted as 10. Generally, the composite scaffolding plank 10 is formed from a plurality of wooden boards 20 held in tight side to side abutment by a plurality of spaced pins 50 that include a cam means 60 thereon. At least one of the wooden boards 20 is a natural wooden board 21. Natural board 21 is not artificially manufactured and includes natural wood grains (ie. aligned wood fibers that, in a piece of wood, rise to the surface in a particular direction) wholly therethrough. In addition, at least one of the wooden boards 20 is a laminated wooden board 88. Laminated board 88 is artificially manufactured and is constructed from a plurality of wooden strips 90 glued together.

The Applicant has achieved the objectives of this invention by pinning a plurality of wooden boards 20 together with pins 50. Specifically, the wooden boards 20 are pinned together transversely through their smallest dimension. It is understood, however, that at the time of the invention many people in the industry thought that manufacturing a scaffolding plank by pinning wooden boards together transversely to their smallest dimension would result in the splitting of the wooden boards. Applicant has been recognized by many in the industry as the first to successfully pin wooden boards together transversely to their smallest dimension without splitting any of the wooden boards.

Applicant's invention is even more significant since the composite plank 10 meets and exceeds prevailing OSHA and SPIB requirements and actually outperforms prior art planks. In addition, Applicant's composite plank 10 has achieved substantial commercial success. Due to its long-felt need, stellar performance, and commercial success, the composite plank 10 is now recognized as the third type of scaffolding plank by renowned industry organizations, such as the Carpenter's Union, the Scaffold Industry Association, and the Masonry Construction Magazine.

Each of the natural boards 21 has a top 26, a bottom 28, opposing sides 22, and opposing ends 24. Typically, the natural boards 21 are elongated in a lengthwise direction measured from end 24 to end 24. The sides 22 extend parallel to the lengthwise direction and preferably normal to the ends 24. In addition, each of the natural boards 21 has a natural board height 25 defined as the perpendicular distance between the natural board top 26 and the natural board bottom 28. In the preferred embodiment, the natural board height 25 is the smallest dimension of each natural board 21.

Figure 10:
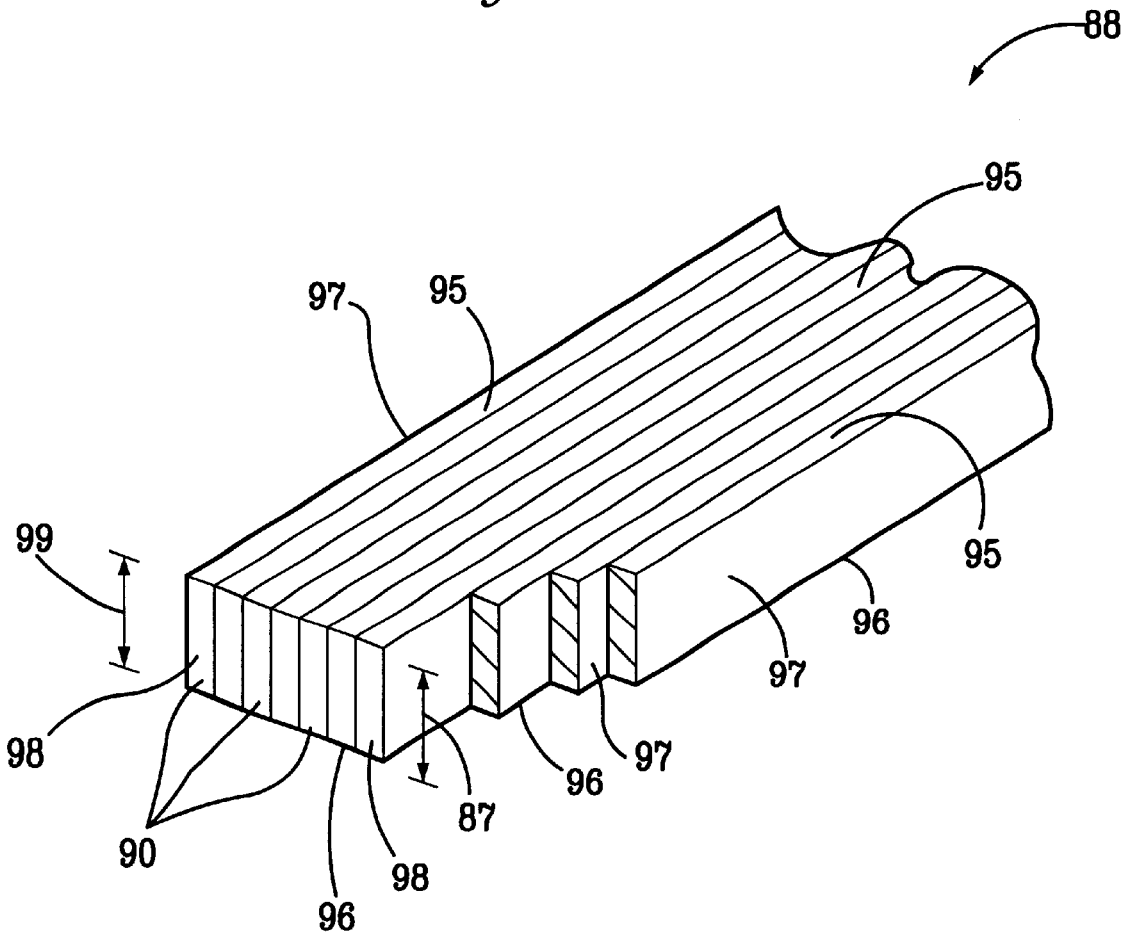
FIG. 10 is a partial isometric cut-away view of one laminated board.

Each of the laminated boards 88 is constructed from a plurality of wooden strips 90 glued together. As best seen in FIG. 10, each wooden strip 90 includes a top 95, a bottom 96, opposing sides 97, and opposing ends 98. Typically, the wooden strips 90 are elongated in a lengthwise direction measured normal to the strip ends 98. The strip sides 97 extend parallel to the lengthwise direction and preferably normal to the strip ends 98. Moreover, each of the wooden strips 90 has a wooden strip height 87 defined as the perpendicular distance between the wooden strip top 95 and the wooden strip bottom 96.

The wooden strips 90 are positioned in side to side parallel abutment so that both sides 97 of each wooden strip 90 abut the side 97 of an adjacent strip 90 (except for the strips 90 adjacent a natural board 21 or at each lateral end of the plank 10, as will be described herein). The strips 90 are held in such relative positions by glue included therebetween.

Each laminated board 88 includes a top 91, a bottom 92, opposing sides 93, and opposing ends 94. Moreover, the strips 90 are positioned so that the strip tops 95 collectively comprise the laminated board top 91, the strip bottoms 96 collectively comprise the laminated board bottom 92, and the strip opposing ends 98 collectively comprise the laminated board opposing ends 94. In addition, the strip sides 97 of the strips 90 located at each transverse end of the laminated board 88 comprise the laminated board opposing sides 93. Moreover, each of the laminated boards 88 has a laminated board height 99 defined as the perpendicular distance between the laminated board top 91 and the laminated board bottom 96. In the preferred embodiment, the laminated board height 99 is the smallest dimension of each laminated board 88.

In the preferred embodiment, each wooden strip height 87 is equal so as to form a substantially flat surface on the laminated board top 91 and the laminated board bottom 92. In this embodiment, the wooden strip height 87 is equal to the laminated board height 99. Also in the preferred embodiment, all wooden strip ends 98 are aligned so that laminated board ends 94 form a substantially continuous surface.

In the composite scaffolding plank 10, the plurality of wooden boards 20 are positioned in side to side parallel abutment. Typically, the wooden boards 20 have a substantially equal height. That is, the natural board height 25 of each natural board 21 is equal to the laminated board height 99 of each laminated board 88. Consequently, when positioned as described above, the wooden boards 20 form a substantially flat continuous surface along their tops, 26 and 91, and along their bottoms, 28 and 92. Also preferably, all natural board ends 24 and laminated board ends 98 are aligned so as to form a substantially continuous surface. Therefore, when formed of wooden boards 20 having substantially equal lengths, each end, 24 or 98, of the composite scaffolding plank 10 forms a substantially continuous surface.

The natural board sides 22 and the laminated board sides 93 are relatively flat such that adjacent wooden boards 20 are in contact along their full length. If a natural board 21 is adjacent a laminated board 88, then the corresponding adjacent natural board side 22 abuts the corresponding laminated board side 93. If a natural board 21 is adjacent another natural board 21, then the two corresponding adjacent natural board sides 22 abut each other. If a laminated board 88 is adjacent another laminated board 88, then the two corresponding adjacent laminated board sides 93 abut each other.

A plurality of spaced pins 50 extend substantially through the wooden boards 20 in a substantially transverse direction, normal to the sides, 22 and 93, and normal to the lengthwise direction of the wooden boards 20. The pins 50 preferably extend the full width of the composite scaffolding plank 10.

In relation to the laminated boards 88, the pins 50 extend through each wooden strip 90 in a substantially transverse direction, normal to the wooden strip sides 97, and normal to the lengthwise direction of the wooden strips 90. Also, the pins 50 extend through the wooden strips 90 in a direction substantially normal to the glued junction of the wooden strips 90.

Attached to each of the pins 50 is a cam means 60 for pulling and holding the wooden boards 20 together. Preferably, the cam means 60 is an integral helical thread 64 that extends the length of each pin 50.

In the preferred embodiment, the pins are twist lock pins 80. The twist lock pins 80 are formed from an elongated piece of metal having a square cross section, the square. A torque applied to the square twists and plastically deforms the square. After deformation, the corners of the original square form the helical thread 64 of the twist lock pin 80 and form the outer diameter of the helical thread 64. In addition, the center portion of the sides of the square form the root diameter of the helical thread 64. However, the helical threads 64 may comprise conventionally cut threading.

As each pin 50 presses into the wooden boards 20, the helical thread 64 embeds into the wooden boards 20 and causes the pin 50 to rotate. The pin 50 turns and pulls the wooden boards 20 together. Further, because the helical threads 64 embed into the wooden boards 20, the helical threads 64 anchor the pin 50 in position and hold the wooden boards 20 together. Typically, while the pins 50 are inserted, an external force presses the wooden boards 20 laterally together slightly compressing the wooden boards 20 and forcing the sides, 22 and 93, into tight abutment. As a consequence, when the external force is removed, the wooden boards 20 are no longer compressed and create a tension in the anchored pins 50. The tension prevents separation of the wooden boards 20 and holds them in tight abutment.

Preferably, the aligned wooden boards 20 have a plurality of transverse bores 40 extending substantially therethrough to facilitate placement of the pins 50 in the wooden boards 20. Thus, the bores 40 are provided before placement of the pins 50 in the wooden boards 20. The bores 40 are aligned such that each bore extends substantially the full width of the composite scaffolding plank 10. A corresponding aperture 44 in at least one of the sides, 22 or 93, of the composite scaffolding plank 10 for each of the bores 40 provides access to the bore 40 and a place of entry for the corresponding pin 50. The outer diameter of the helical thread 64 is greater than the diameter of the bore 40; and the root diameter of the helical thread 64 is preferably less than the diameter of the bore 40. Whereby, the helical thread 64 embeds in the wooden boards 20 as the pin 50 is pressed into the bore 40.

Although the composite scaffolding plank 10 may be formed of any number of wooden boards 20 (provided at least one wooden board 20 is a natural board 21 and at least one wooden board 20 is a laminated board 88) having virtually any width, the preferred embodiment of the composite scaffolding plank 10 includes two natural boards 21 and one laminated board 88 with the laminated board 88 preferably positioned between the two natural boards 21. Each of the natural boards 21 preferably has nominal dimensions as follows: a height of 1½ inches and a width of 3½ inches, and the laminated board 88 preferably has nominal dimensions as follows: a height of 1½ inches and a width of 1½ to 4 inches. In this way, the composite scaffolding plank 10 is made of conventionally sized and readily available wooden boards 20 that form a composite scaffolding plank 10 having a height of 1½ inches and a width of 7 to 11 inches (nominal).

The method for forming wide wooden planks 10 from two or more wooden boards 20, generally, includes positioning the wooden boards 20 in side to side parallel abutment as described herein and subsequently embedding a plurality of spaced pins 50 substantially through the wooden boards 20.

Figure 3:
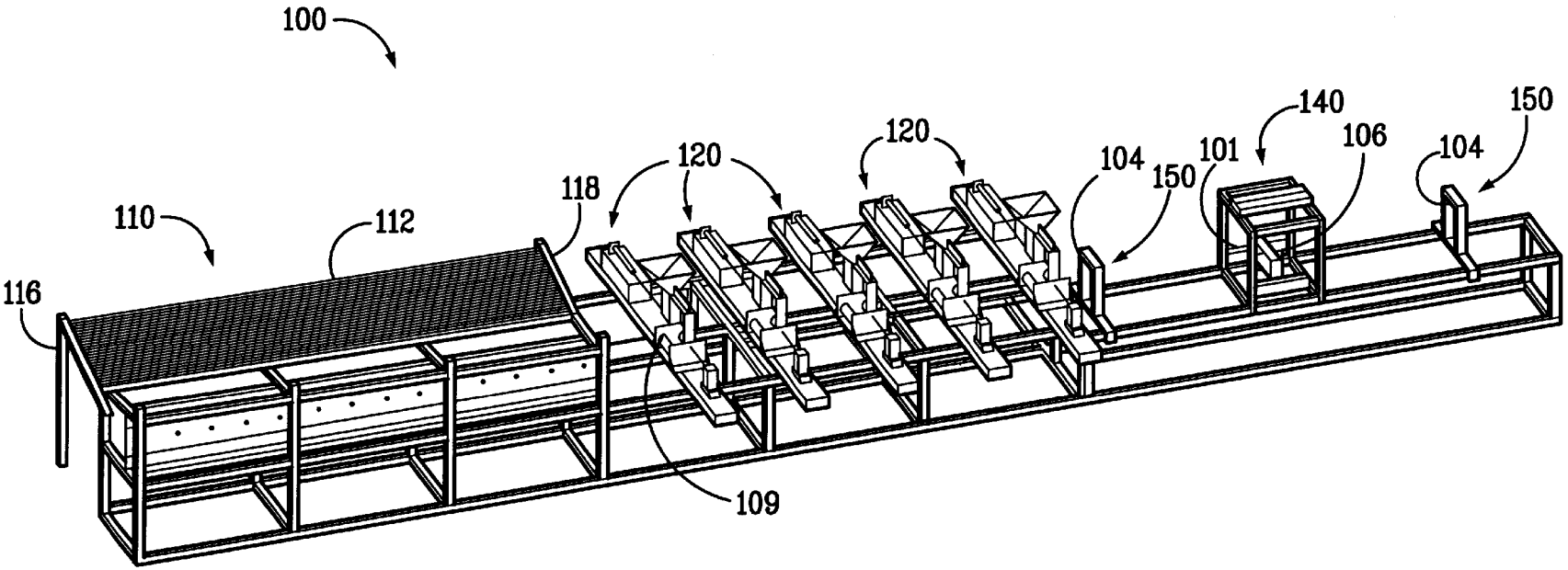
FIG. 3 is an isometric view of the scaffold board pinning machine.
Figure 4:
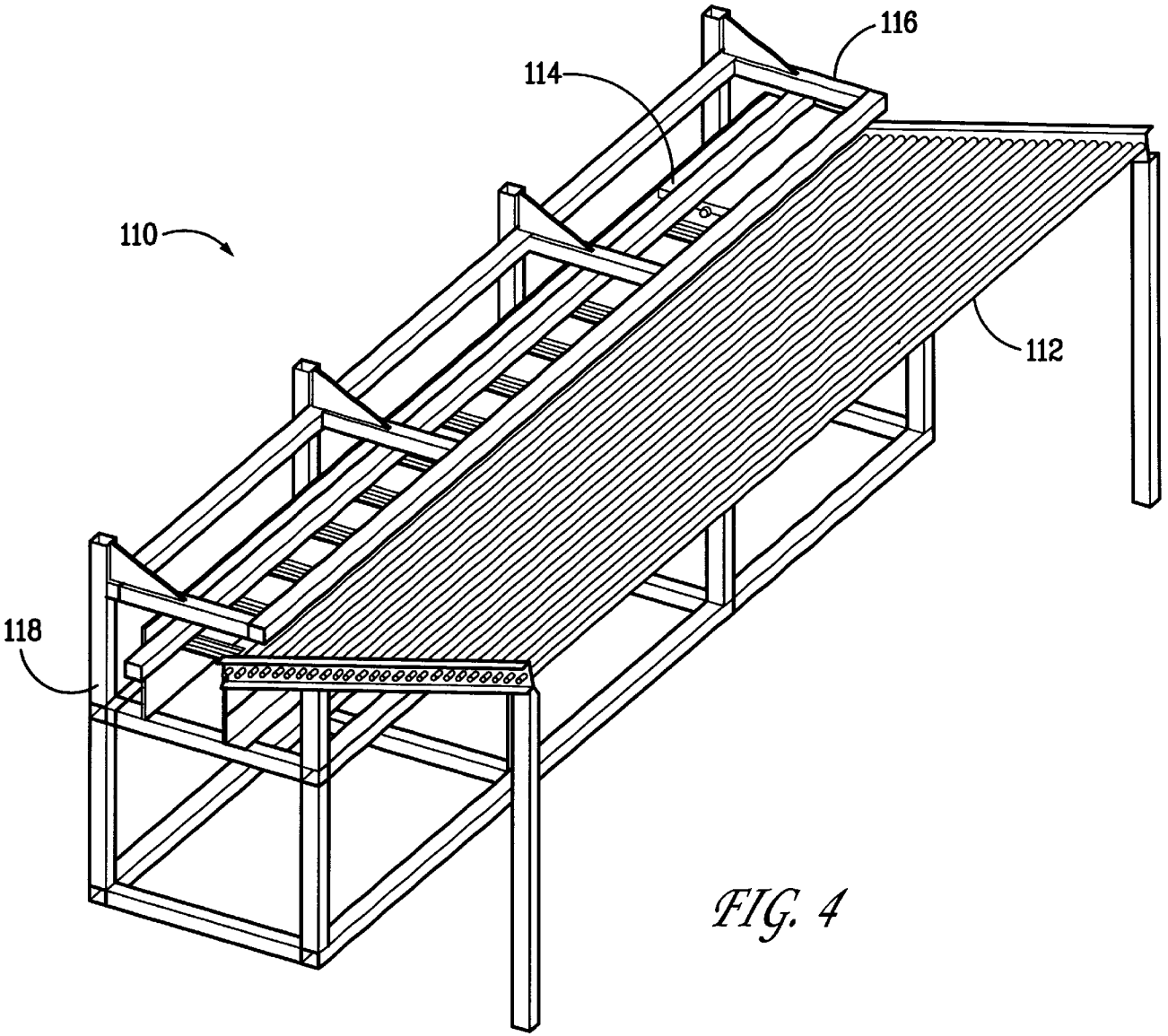
FIG. 4 is an isometric view of the loading station.
Figure 5:
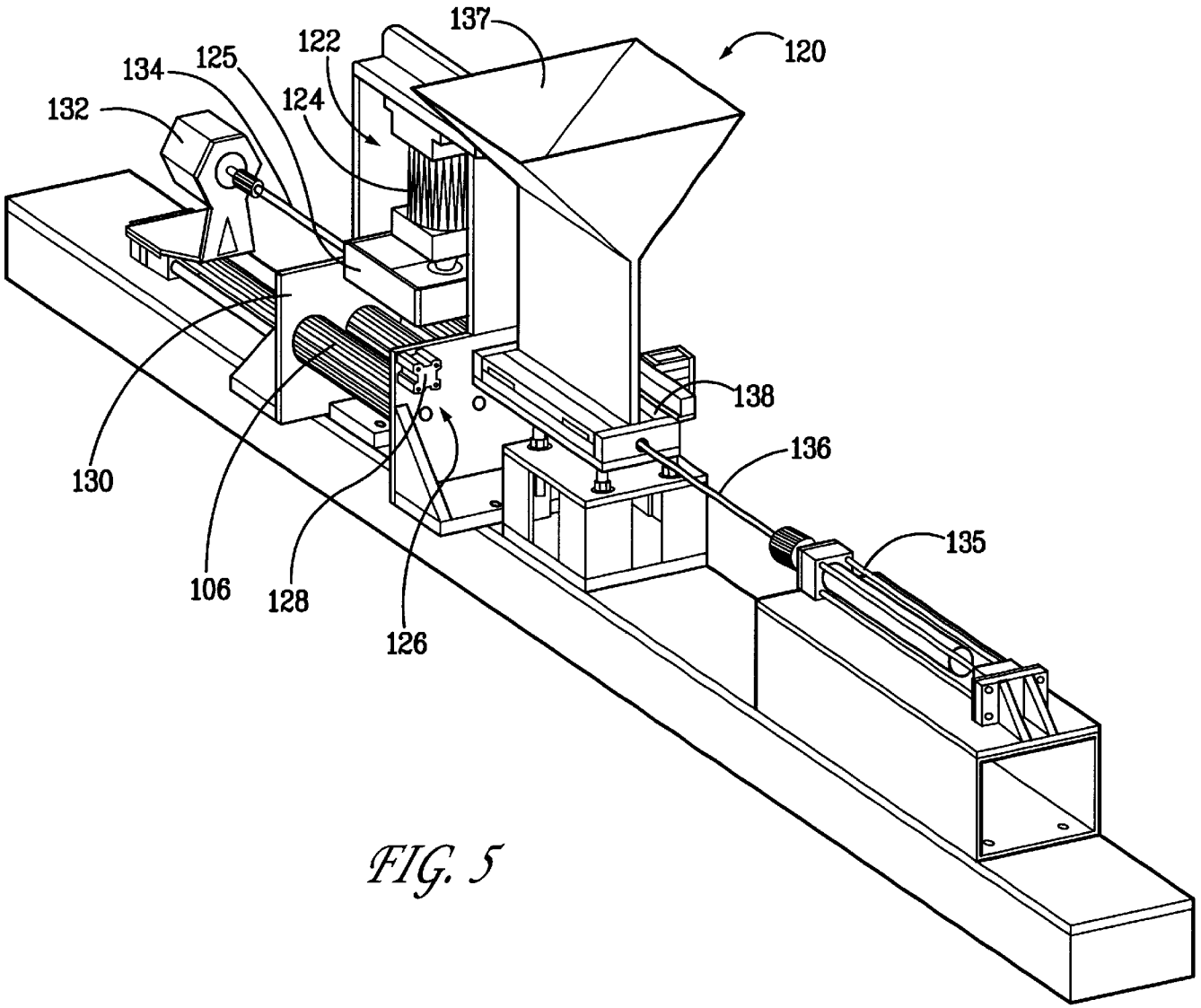
FIG. 5 is an isometric view of a pinning station.
Figure 6:
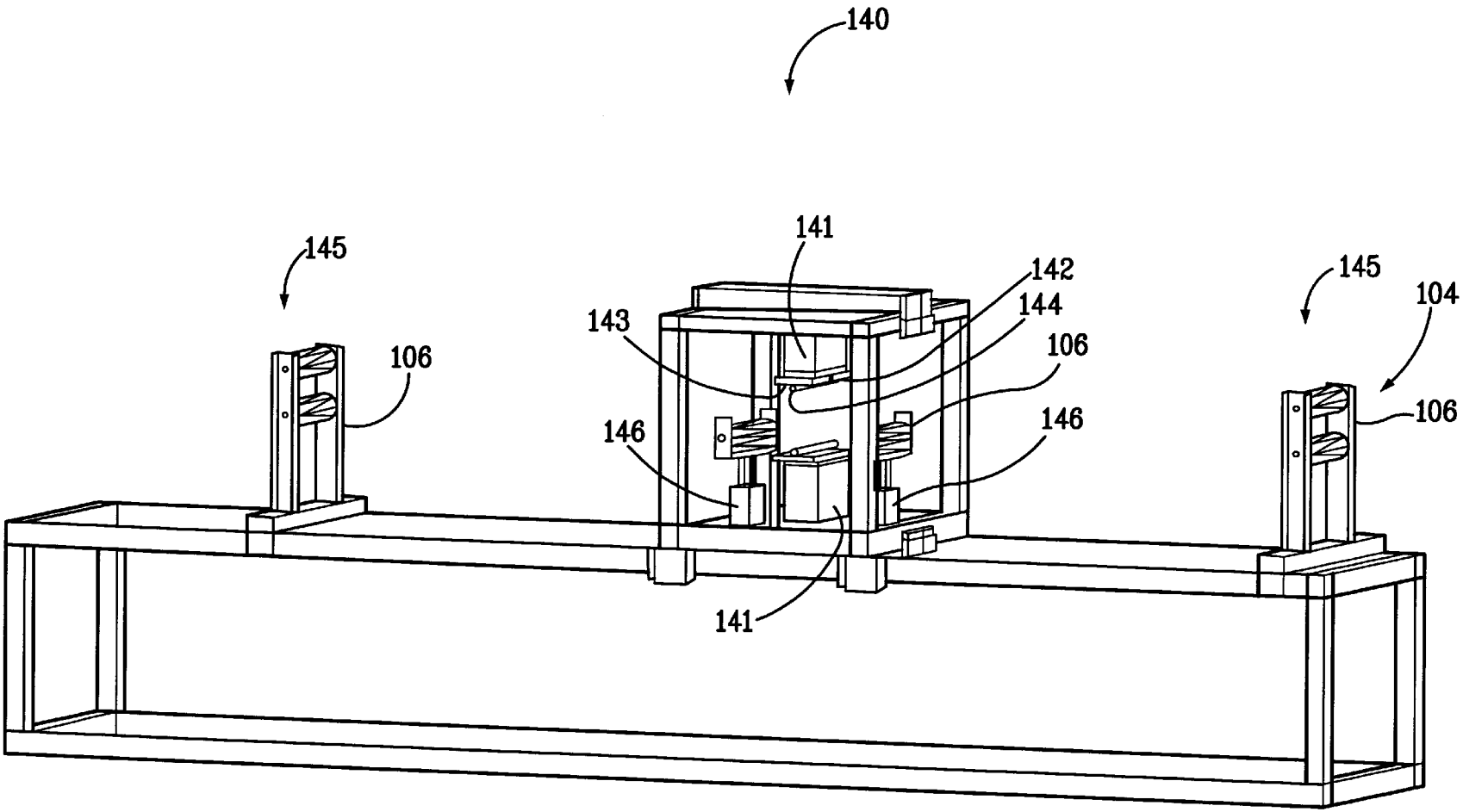
FIG. 6 is an isometric view of the testing station.

The method is accomplished using a scaffold board pinning machine 100 similar to that shown in FIG. 3. As shown, the machine includes a loading station 110, one or more spaced pinning stations 120, a testing station 140, and a conveyance means 150 for moving the wooden boards 20 through the scaffold board pinning machine 100.

The wooden boards 20 slide down an inclined roller deck 112 onto the roller bed 104 of the scaffold board pinning machine 100. The boards 20 enter the roller bed 104 in side to side parallel arrangement.

The roller bed 104 is made of a plurality of rollers 106 held in a horizontal plane and positioned such that their axes are normal to the longitudinal direction of the wooden boards 10 positioned thereon. The rollers 106 of the roller bed 104 are positioned on each component of the scaffold board pinning machine 100 and are free to rotate about their respective axes. The rollers 106 may include one or more drive motors that turn the rollers 106 and thereby move the wooden boards 20 supported thereon and, thereby, provide the conveyance means 150.

Alternatively, the preferred embodiment utilizes a hydraulic or pneumatic cylinder 114 positioned proximal the rear end 116 of the loading station 110 to provide the conveyance means 150. Once the boards 20 enter the roller bed 104, the cylinder 114 simultaneously forces all of the boards 20 over the rollers 106 from the loading station 110 toward its forward end 118. Because the cylinder 114 forces all of the boards 20 simultaneously, the cylinder 114 aligns the ends, 24 and 94, of the boards 20. Thus, the loading station 110 and conveyance means 150 may serve to align the wooden boards 20 such that their ends, 24 and 94, form a substantially continuous surface. Subsequent sets of boards 20 advance the previous sets over the roller bed 104.

From the loading station 110, the boards 20 enter one or more spaced pinning stations 120. Preferably, the scaffold board pinning machine 100 includes a plurality of pinning stations 120 the number of which equals the predetermined number of pins 50 for each composite scaffolding plank 10. Commonly, the pins 50 are spaced every twenty to twenty-three inches. Thus, for example, a ten foot long composite scaffolding plank 10 would include six pins 50; and the scaffold board pinning machine 100 for making the ten foot long composite scaffolding plank 10 would include at least six pinning stations 120. The preferred number of pinning stations 120 is six (6).

The pinning station 120 includes a horizontal compression means 126, a vertical compression means 122, a drill 132, a pin holder 138, and a pin press 135. In operation, the pinning station 120 compresses the boards 20 transversely and vertically. The vertical compression maintains the relative position of the boards 20 while the scaffold board pinning machine 100 embeds the pins 50. The pinning station 120 drills a plurality of lateral bores 40 through the aligned boards 20 to facilitate the embedding of the pins 50. Finally, the pinning machine embeds the pins 50 transversely through the boards 20.

Typically, the vertical compression means 122 is a hydraulic or pneumatic vertically mounted cylinder 124 that has a relatively wide ram head 125. With the boards 20 in place, the vertically mounted cylinder 124 activates such that the ram head 125 engages the top, 26 and 91, of the boards 20. The ram head 125 is sufficiently wide that it engages all of the boards 20 simultaneously and holds the boards 20 between the ram head and the rollers 106.

The horizontal compression means 126 is generally one or more hydraulic or pneumatic horizontally mounted cylinders 128. With the boards 20 in place, the horizontally mounted cylinder 128 engages and compresses the boards 20. Therefore, in addition to providing the desired compression, the horizontally mounted cylinder 128 maintains the relative position of the boards 20 during drilling of the bores 40 and embedding of the pins 50.

Once held in position, the drill 132 activates and drills a lateral bore 40 completely through the aligned boards 20. The drill 132 is positioned on the pinning station 120 such that the drill bit 134 engages one of the sides, 22 or 93, of the nearest board 20 normal to the side, 22 or 93. Upon completion of the drilling, the drill 132 retracts the drill bit 134 from the boards 20.

The pins 50 are gravity fed through a pin hopper 137 to a pin holder 138. The pin holder 138 maintains the pin 50 in a position aligned with the bores 40 (ie. lateral to the sides, 22 and 93, of the boards 20 and positioned approximately midway between the top, 26 and 91, and bottom, 28 and 92, of the boards 20).

The pin press 135 is typically a hydraulic or pneumatic cylinder constructed and is positioned to exert a force on the pin 50 sufficient to push the pin 50 into the bore 40. Preferably, the pin press 135 is mounted opposite the drill 132 on the pinning station 120 with the axis of the drill bit 134 and the axis of the pin press ram 136 substantially aligned. Thus, the drill 132 drills the bore 40 from one side, 22 or 93, of the boards 20; and the pin press 135 forces the pin 50 into the bore 40 from the opposite side, 22 or 93, of the boards 20. As previously stated, the pins 50 include a cam means 60 which embeds into the boards 20 as the pin 50 is placed therein. The cam means 60 acts as an anchor maintaining the pin 50 within the boards 20 as well as maintaining the relative position of the boards 20.

After the pin 50 is embedded into the boards 20, the vertical compression means 122 and the horizontal compression means 126 disengage. With the boards 20 no longer compressed, the pins 50 embedded within the boards 20 experience a tensioning due to the boards 20 returning to their noncompressed state.

Once released from the pinning stations 120, the conveyance means 150 advances the composite scaffolding plank 10 to the testing station 140. The composite scaffolding plank 10 advances until it is substantially centered in the testing station 140. When centered, a pair of spaced supports 145 each having a pair of rollers 106 support the composite scaffolding plank 10. The pair of rollers 106 of the supports 145 are vertically aligned to support the composite scaffolding plank 10 during both upward and downward testing.

Two vertically mounted hydraulic or pneumatic testing cylinders 141 are positioned substantially equidistant between the supports 145. One of the testing cylinders 141 is positioned above the composite scaffolding board 10 to exert a downward force thereon; and the other testing cylinder 141 is positioned below the composite scaffolding board 10 to exert an upward force thereon. The testing cylinders 141 are mounted with their rams 142 positioned so that, upon actuation, the rams 142 exert a force on the composite scaffolding plank 10. A contact rod 144 attached to the ram contact surface 143 extends in a direction transverse to the lengthwise direction of the composite scaffolding plank 10 being tested. Thus, when each testing cylinder 141 is actuated, the respective contact rod 144 exerts a force on the composite scaffolding plank 10 that is substantially a transverse line. Preferably, the magnitude of the force is 500 pounds or more.

To accommodate for the weight of the composite scaffolding plank 10 during testing in the upward direction, the testing station 140 includes compensating cylinders 146 that have rollers thereon. When testing in the upward direction, the compensating cylinders 146 lift the composite scaffolding plank 10 until it contacts the upper rollers 106 of the supports 145. In this way, the lower testing cylinder 141 is not lifting the composite scaffolding plank 10 during the upward test. After the test, the compensating cylinders 146 lower the scaffolding plank 10 onto the lower rollers 106 of the supports 145. The compensating cylinders 146 retract sufficiently that they do not contact the composite scaffolding plank 10 during its downward testing.

After sequentially testing the composite scaffolding board 10 in both directions, the testing cylinder 141 releases the force on the composite scaffolding plank 10 and the conveyance means 150 advances the composite scaffolding plank 10 from the scaffold board pinning machine 100. Only one of the testing cylinders 141 is actuated at a time to permit testing of the composite scaffolding plank 10 in both directions.

Although the preferred embodiment of the testing station 140 includes two testing cylinders 141, it may use only one testing cylinder 141. In that event, however, the composite scaffolding plank 10 must be manually turned to test both sides of the plank 10.

The above described machine and method may be applied to a wide wooden plank to increase the strength and the safety of the plank. To increase the strength of the plank, it is first cut longitudinally into a plurality of natural boards 21, preferably three (3). A laminated board 88 is placed preferably between two of the natural boards 21 and the wooden boards 20 are placed in side to side parallel abutment. The wooden boards 20 are then reattached as described above using embedded pins 50. When reconnected, the composite scaffolding plank 10 has greater strength than the original wooden plank due to the embedded pins 50 and the inclusion of the laminated board 88. Further, a failure in one of the wooden boards 20 will not spread to adjacent wooden boards 20.

Test Results

The composite scaffolding plank 10 has been tested and compared against comparable solid single board planks, laminated planks, and pinned planks including only natural boards 21 and no laminated boards 88 (such as the plank disclosed in this Applicant's copending applications). Among others, the flexural stress, modulus of elasticity, horizontal shear stress, coefficient of variation, and maximum deflection of the composite scaffolding plank 10 were tested and compared. The results tabulated in FIG. 7 correspond to a test which compared a Dense Industrial 65 Scaffold Plank, which is a very common type and grade of single board plank in the field today, against a composite scaffolding plank 10, a laminated plank, and a pinned plank including only natural boards 21 (and no laminated board 88), each plank having substantially the same dimensions. From the comparison results, it is clear that the composite scaffolding plank 10 not only has a greater modulus of elasticity than all other prior art planks, but that the composite scaffolding plank 10 can also withstand more flexural stress than all other prior art planks. In addition, FIG. 8 shows that the composite scaffolding plank 10 withstands as much horizontal shear stress before breaking as the laminated plank, which load is higher than the solid single board plank as well as the pinned plank with only natural boards.

Thus, FIG. 8 shows that not only is the composite scaffolding plank 10 stronger than prior art planks, but the composite scaffolding plank 10 also has greater elasticity than the prior art planks thereby being better able to retain its pre-stressed shape.

FIG. 8 tabulates and compares the failure test results of the same type of boards. As can be seen, the composite scaffolding plank 10 fails at a higher load per square inch than all comparable prior art planks. Thus, the composite scaffolding plank 10 can withstand greater force before breaking.

FIG. 9 tabulates and compares the deflection results on the same type of boards given a loading of 50 pounds per square foot. As can be seen, the composite scaffolding plank 10 deflects less distance than the prior art planks at the same load. Further, FIG. 9 illustrates that each type of board is well within the OSHA allowable deflection at that load rating. The composite scaffolding plank 10 also is well within the OSHA allowable deflection at all other load ratings.

In Operation

The use of at least one natural board 21 and at least one laminated board 88 in the composite plank 10, as described herein, provides the composite plank 10 with the advantages of both the prior art single solid board plank and the laminated plank while greatly reducing, if not eliminating, their respective disadvantages. Because the composite plank 10 is constructed from a plurality of narrower wooden boards 20, the use of the wider and much more expensive single solid board planks is no longer needed. However, by incorporating two natural wooden boards 21 within the composite plank 10, the composite plank 10 retains the strength inherent in natural wood as well as the relative ease of manufacture. In addition, by utilizing at least one laminated board 88 with the wooden strips 90 glued in their particular orientation, the composite plank 10 is more rigid and has greater flexoral strength than if only natural boards 21 were included in the composite plank 10. However, by pinning the laminated board 88 to two natural boards 21, the composite plank 10 has a load capacity and strength greater than if the entire composite plank 10 were laminated.

By including a laminated board 88 therein with the wooden strips 90 glued in their particular orientation, the composite plank 10 possesses greater rigidity than if the entire composite plank 10 were constructed of natural wood. This additional rigidity is important since, under OSHA and SPIB standards, a scaffolding plank having a given length is allowed to have only a certain amount of deflection at given load ratings. Adding rigidity to a composite plank 10 by incorporating a laminated board 88 helps to ensure that the deflection of the composite plank 10 at the given load ratings remains safe for workers and within OSHA and SPIB guidelines.

The additional rigidity provided by the laminated board 88 is due to the orientation of the wooden strips 90. The orientation of the wooden strips 90 is such that they are glued to each other in a direction parallel to the laminated boards sides 97 as opposed to a direction parallel to the laminated board top and bottom, 95 and 96. Thus, the pins 50 extend transversely to the glued junction of the wooden strips 90. Any weight or force applied on top of the composite plank 10 then acts in a direction parallel to the wooden strip sides 97 and normal to the wooden strip tops 95. Because the dimension of each wooden strip side 97 (ie., wooden strip height 99) is substantially larger than the dimension of each wooden strip top 95, the deflection of the laminated board 88 in the direction of the applied force is relatively small as compared to the deflection that would be caused by a force applied to a laminated board with wooden strips glued parallel to the plank top. Due to its pinned attachment to the natural boards 21, the laminated board 88 also imparts its inherent rigidity to the remainder of the plank 10. In fact, tests have shown that the use of one laminated board 88 as described herein provides a plank having a 10 foot span with approximately 1 inch less overall deflection than if only natural boards 21 were used on the plank.

The use of pinned narrower wooden boards 20 also inherently increases the strength of the composite plank 10. Under OSHA standards, the size of knots allowable in narrower boards is much smaller than that allowable in wider boards. Knots are inherent weak points in wooden boards. Thus, the use of narrower boards, which necessarily must have smaller knots to comply with OSHA regulations, increases the overall strength of the composite plank 10.

The use of boards 20 with smaller knots in conjunction with the spaced apart pinning of such boards 20 creates a sharing of load on the composite plank 10 which increases the overall strength of the composite plank 10 up to 20%.

The use of multiple narrower wooden boards 20 pinned together also creates an additional worker safety factor which is unique to the composite plank 10. When the composite plank 10 is overstressed to the point of failure, only one of the wooden boards 20 will normally break and such board 20 will normally break only up to the nearest pin 50. The worker standing on the composite plank 10 can hear and see the single wooden board 20 breaking, allowing the worker enough time to get to safety. Prior art scaffolding planks do not have this worker safety factor. When a prior art scaffolding plank breaks, the failure is typically sudden putting the life of the worker in danger.

Moreover, the use of laminated board 88 having wooden strips 90 oriented in the direction described herein provides a plank 10 with a natural non-slippery top surface. The texture at the top surface is provided by the naturally "rough" wooden strip tops 95 of the laminated board 88 and their glued junctions. Thus, a worker stepping on plank 10 steps on the gripping or textured surface provided by the wooden strip tops 95 (and their glued junctions) and is thereby unlikely to slip while working on or passing through plank 10.

When used in dry, desert-like conditions, natural boards 21 tend to shrink. Comparatively, laminated boards 88 shrink less than natural boards 21 in such conditions. Thus, the use of laminated board 88 in conjunction with natural boards 21 provides plank 10 with less overall shrinkage when used in dry, desert-like conditions than if only natural boards 21 were used on the plank 10.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

What is claimed is:

1. A method for forming a scaffolding plank from two or more wooden boards, comprising:

providing a plurality of wooden boards, at least one of said wooden boards being a natural wooden board and at least one of said wooden boards being a laminated wooden board;

positioning said wooden boards in side to side abutment, each of said wooden boards including two sides and a lengthwise direction, each of said sides being flat and having a height and said height being the smallest dimension of said wooden boards;

compressing said plurality of wooden boards vertically so that the top surfaces of said plurality of wooden boards are co-planar and concurrently compressing said plurality of wooden boards transversely before revolvingly embedding at least three spaced apart pins;

revolvingly embedding at least three spaced apart pins transversely through said plurality of wooden boards, normal to said sides of said plurality of wooden boards, and normal to said lengthwise direction of said plurality of wooden boards, each of said at least three spaced pins having helical threads; and subsequently removing the compression on said plurality of wooden boards;

whereby the helical threads of said plurality of helical pins become anchored within each of said wooden boards thereby fixing and maintaining said wooden boards in relative position.

2. A method as in claim 1 wherein said providing step comprises providing two of said natural wooden boards and one of said laminated wooden board.

3. A method as in claim 2 wherein said positioning step comprises positioning said laminated wooden board in between said two natural wooden boards.

4. A method as in claim 3 wherein said at least one laminated wooden board provided in said providing step is constructed from a plurality of wooden strips glued together in a direction parallel to said sides of said wooden boards.

5. A method as in claim 4 further comprising aligning said plurality of wooden boards such that their ends form a substantially continuous surface before revolvingly embedding said at least three spaced helical pins.

6. A method as in claim 4 further comprising:

said revolvingly embedding step comprising drilling at least three spaced bores transversely through said plurality of wooden boards and forcing said helical pins through said bores;

said helical pins having a thread outer diameter and further having a thread root diameter;

each of said drilled bores having a bore diameter;

said bore diameter greater than said thread root diameter and less than said thread outer diameter.

7. A method as in claim 6 further comprising:

said revolvingly embedding step including positioning a drill at a lateral outside edge of said plurality of wooden boards and a pin press at an opposite outside edge of said plurality of wooden boards;

said drill having a drilling axis;

said pin press having a pin press axis;

said drilling axis and said pin press axis substantially aligned;

whereby said drilling step and said forcing step are sequentially performed while said plurality of wooden boards are laterally and vertically compressed.

8. A method as in claim 7 further comprising:

each of said at least three spaced helical pins is a twist lock pin having a square cross section.

9. A method for increasing the strength of a wooden scaffolding plank comprising the steps of:

cutting said plank longitudinally into a plurality of natural wooden boards;

providing at least one laminated wooden board;

positioning said plurality of natural wooden boards and said at least one laminated wooden board in side to side parallel abutment, each of said natural and laminated wooden boards including two sides and a lengthwise direction, each of said sides being flat and having a height and said height being the smallest dimension of said natural and laminated wooden boards;

compressing said plurality of wooden boards vertically so that the top surfaces of said plurality of wooden boards are co-planar and concurrently compressing said plurality of wooden boards transversely before revolvingly embedding said at least three spaced helical pins;

revolvingly embedding at least three spaced helical pins transversely through said natural and laminated wooden boards, normal to said sides of said natural and laminated wooden boards, and normal to said lengthwise direction of said natural and laminated wooden boards, each of said at least three spaced helical pins having helical threads; and subsequently removing the compression on said plurality of wooden boards;

whereby the helical threads of said at least three spaced helical pins become anchored within each of said natural and laminated wooden boards thereby fixing and maintaining said natural and laminated wooden boards in relative position.

10. A method as in claim 9 wherein said cutting step comprises cutting said plank longitudinally into three of said natural wooden boards.

11. A method as in claim 10 wherein said providing step comprises providing one of said laminated wooden boards.

12. A method as in claim 11 wherein said positioning step comprises positioning said one laminated wooden board in between two of said three natural wooden boards.

13. A method as in claim 12 wherein said at least one laminated wooden board provided in said providing step is constructed from a plurality of wooden strips glued together in a direction parallel to said sides of said wooden boards.

14. A method as in claim 13 further comprising aligning said natural and laminated wooden boards such that their ends form a substantially continuous surface before revolvingly embedding said at least three spaced helical pins.

15. A method as in claim 12 further comprising:

said revolvingly embedding step comprising drilling at least three spaced bores transversely through said plurality of wooden boards and forcing said helical pins through said bores;

said helical pins having a thread outer diameter and further having a thread root diameter;

each of said drilled bores having a bore diameter; and said bore diameter greater than said thread root diameter and less than said thread outer diameter.

16. A method as in claim 15 wherein:

said revolvingly embedding step includes positioning a drill at a lateral outside edge of said plurality of wooden boards and a pin press at an opposite outside edge of said plurality of wooden boards;

said drill having a drilling axis;

said pin press having a pin press axis;

said drilling axis and said pin press axis substantially aligned;

whereby said drilling step and said forcing step are sequentially performed while said plurality of wooden boards are laterally and vertically compressed.

17. A method as in claim 16 wherein:

each of said at least three spaced helical pins is a twist lock pin having a square cross section.

* * * * *